United States Patent [19]

Saunders et al.

[11] Patent Number: 5,071,377

[45] Date of Patent: Dec. 10, 1991

[54] INBOARD MARINE ENGINE FLUSHING DEVICE

[76] Inventors: Donald P. Saunders; Steve A. Martie, both of 1114 SE. 12th Ct., Unit #2, Cape Coral, Fla. 33990

[21] Appl. No.: 619,713

[22] Filed: Nov. 29, 1990

[51] Int. Cl.[5] ..... B63H 21/10

[52] U.S. Cl. ..... 440/88; 134/167 R

[58] Field of Search ..... 440/88, 113, 900; 134/167 R, 168 R, 169 A

[56] References Cited

U.S. PATENT DOCUMENTS

| | | | |
|---|---|---|---|
| 3,202,123 | 8/1965 | Goodfriend | 440/88 |
| 3,347,202 | 10/1967 | McCurry | 440/113 |
| 3,500,786 | 3/1970 | Oliver | 440/88 |

*Primary Examiner*—Jesus D. Sotelo

*Attorney, Agent, or Firm*—Charles J. Prescott

[57] ABSTRACT

An inboard marine engine flushing device for flushing the engine of a boat in dry-dock including a flexible, resiliently deformable preferably elastomeric conical shaped hollow member having a smaller inlet and a larger outlet. The outlet includes a water sealing surface which is sized to sealably engage around an engine sea water inlet fitting fixed to a boat hull. A preferably T-shaped hollow water supply conduit is also included having a first leg connected to the inlet end, a second leg connected to a pressurized water supply, and a third leg which is plugged or otherwise sealably engaged into a telescopically extendable and lockable elongated ground engaging member. The ground engaging member lockably retains the water sealing surface forcibly urged against the boat hull during engine flushing. The conical member is also bendably resilient to accommodate hull surfaces which are at a substantial angle to horizontal in the vicinity of the sea water inlet fitting.

10 Claims, 1 Drawing Sheet

INBOARD MARINE ENGINE FLUSHING DEVICE

BACKGROUND OF THE INVENTION

This invention is generally related to flushing devices for marine propulsion units, and more particularly to a device capable of being sealably engaged by forcible urging against the exterior surface of an out-of-water or dry-docked boat.

The flushing of sea water from a water-cooled marine engine of a boat is particularly desirable to extend the useful life of the engine and to maintain cooling water passages free and clear of debris and buildup. This is particularly important in areas of salt water.

Marine engines receive sea water for cooling in generally two different manners. The first is though inlets formed in the stern or outboard lower unit of inboard-outboard and outboard propulsion systems. There are a variety of devices useful to delivering flushing water into these exteriorly positioned lower drive units. One such typical device is shown in U.S. Pat. No. 4,589,851 to Karls.

The second more traditional mode of sea water inlet is through a louvered or apertured fitting connected on the exterior hull of the boat which is in fluid communication with the engine cooling system. Only one device is known to applicant which in any way addresses the flushing of such types of inboard engines having hull-mounted water intake fittings. This device is shown in U.S. Pat. No. 3,134,388 to Peloso which is directed to a molded plastic device fabricated of semi-rigid plastic such as polyethelene. However, the Peloso device does not provide any significant degree of misalignment accommodation and must be propped in substantially perpendicular orientation to the hull at the sea water inlet.

The present invention provides for a simple and economical to manufacture device which may be readily deployed between the hull of an out-of-water boat and the ground, regardless of the hull configuration or angle so as to quickly and easily deliver pressurized city or ground water into the sea water inlet fitting on the hull for flushing the engine.

BRIEF SUMMARY OF THE INVENTION

This invention is directed to an inboard marine engine flushing device for flushing the engine of a boat in dry-dock including a flexible, resiliently deformable preferably elastomeric conical shaped hollow member having a smaller inlet and a larger outlet. The outlet includes a water sealing surface which is sized to sealably engage around an engine sea water inlet fitting fixed to a boat hull. A preferably T-shaped hollow water supply conduit is also included having a first leg connected to the inlet end, a second leg connected to a pressurized water supply, and a third leg which is plugged or otherwise sealably engaged into an elongated, telescopically extendable and lockable ground engaging member. The ground engaging member lockably retains the water sealing surface forcibly urged against the boat hull during engine flushing. The conical member is also bendably resilient to accommodate hull surfaces which are at a substantial angle to horizontal in the vicinity of the sea water inlet fitting.

It is therefore an object of this invention to provide a simple and economical to manufacture and use inboard marine flushing device for use in flushing sea water from the marine engine of a boat when out of water.

It is another object of this invention to provide an inboard marine engine flushing device which accommodates a wide range of hull configurations and angular orientation without the need for additional props or support objects.

In accordance with these and other objects which will become apparent hereinafter, the instant invention will now be described with reference to the accompanying drawings.

DETAILED DESCRIPTION OF THE INVENTION

Figure 2:
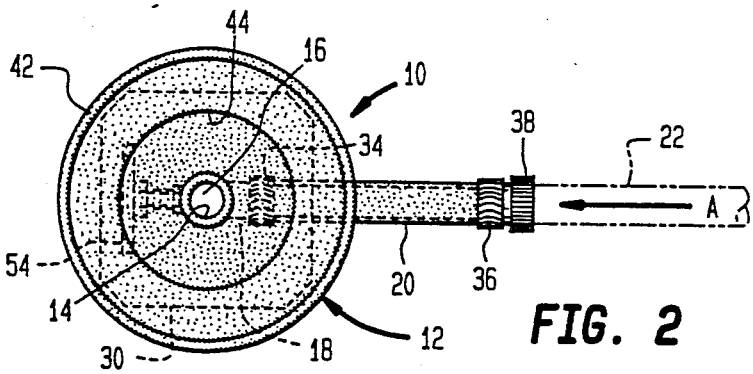
FIG. 2 is a top plan view of FIG. 1.

Referring now to the drawings, the invention is shown generally at numeral 10 and includes a conical-shaped member 12, a generally T-shaped hollow water supply conduit 14 and a telescopically extendable elongated ground engaging tube 24.

One leg 18 of the T-shaped water delivery conduit 14 is connected to a flexible tube 20 by hose clamp 34 which, in turn, is connected to a hose coupling 38 by hose clamp 36. By this arrangement, a conventional garden hose 22 may be connected to coupling 38 so as to deliver pressurized city or ground water into conduit 14 in the direction of arrow A.

A second, upwardly extending leg of T-shaped conduit 14 is connected by a hose clamp 32 at 40 to the conical member 12 which will be described in more detail herebelow. The downwardly extending leg of T-shaped conduit 14 slidably engages within the ground engaging tubular member 24. The lower end of conduit 14 is plugged or sealed at 52. A threaded fastener 26 is threadably engaged into boss 28 connected onto ground engaging tube 24 so that knob 54 may be rotatably tightened to secure any desired position of tube 24 up and down in the direction of arrow B with respect to conduit 14. The lower end of tube 24 includes an enlarged transverse plate 30 which more supportively engages atop the ground G.

Figure 3:
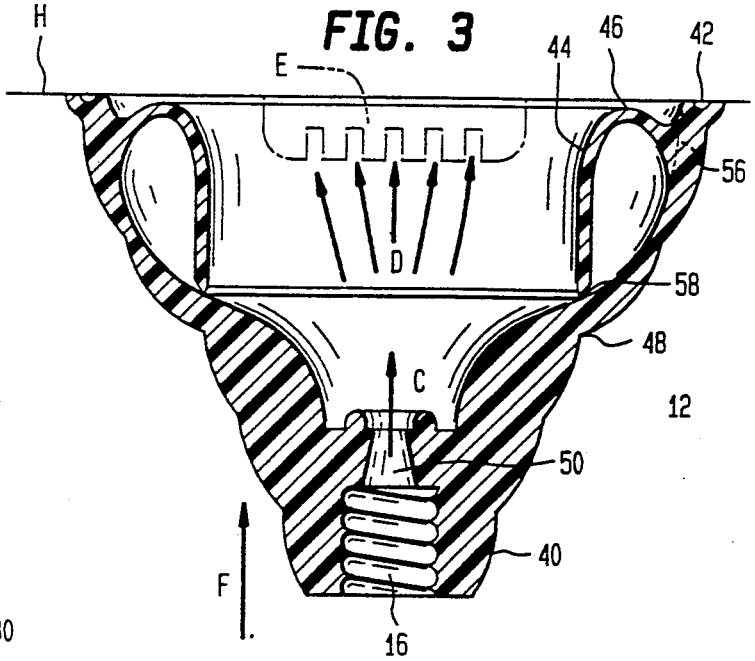
FIG. 3 is an enlarged section view of the upper flexible conical-shaped hull engaging member of FIG. 1.

In FIG. 3, the details of the preferred embodiment of the conical member 12 is there shown. This member 12 is integrally formed of molded resilient, pliable elastomeric material, preferably rubber, and includes a smaller lower end 40 and an enlarged upper end which terminates at a dual-ribbed water sealing surface 42. This water sealing surface 42 is generally planer so as to sealably engage against a boat hull H and is of sufficient size so as to completely surround an engine cooling water inlet fitting shown in phantom at E. This water inlet fitting E connected onto the exterior surface of hull H, includes a plurality of slots or apertures through which sea water or flushing water will flow in the direction of arrows D into the cooling system of the inboard engine.

The smaller lower end 40 includes a molded threaded aperture 16 and a conduit 50. The upper end of conduit 14 may thus be threadably engagable into threads 16 and held for secure retention therewithin by hose clamp 32. By this arrangement, pressurized water introduced in the direction of arrow A will flow upward through conduit 50 into the interior of conical member 12 in the direction of arrow C and then into the water inlet fitting E in the direction of arrows D.

When flushing a marine engine, a primary concern is to insure that substantially all of the pressurized cooling water is forced into the engine cooling system. Otherwise, the possibility of overheating and the damaging of engine cooling parts is increased. The present invention provides for a dual-ribbed sealing surface 42 formed on either side of a groove therebetween. Thus, as the lower end 40 is forcibly urged upward in the direction of arrow F, the water sealing action of surface 42 is effected against hull H.

A secondary water seal is also provided optionally by the addition of a water seal flap 44 which inwardly extends from the interior surface at 56. This water seal flap 44 inwardly extends curving slightly upwardly and then downwardly to contact the interior surface of conical member 12 at 58. As increased force is applied upwardly to the lower end 40 in the direction of arrow F, the secondary water seal flap 44 contacts the hull H at 46. Further increased urging of the lower end 40 upwardly only serves to enhance and broaden the surface contact at 46 because contact at 58 is limiting.

Figure 1:
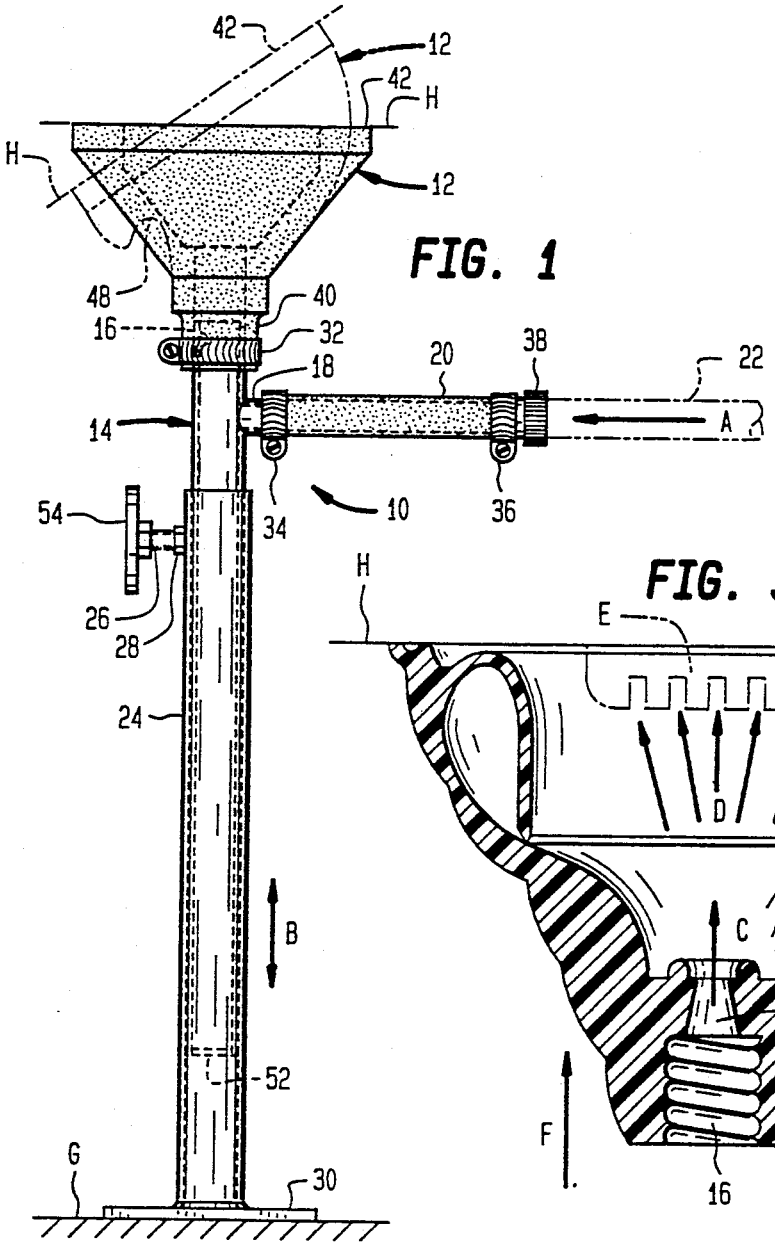
FIG. 1 is a side elevation schematic view of the invention.

Referring particularly to FIGS. 1 and 3, an additional important feature of the present invention is there shown, more particularly in phantom in FIG. 1. This unique feature of the invention facilitates the easy and simple accommodation of exterior hull configurations in the region of the inlet water fitting E which are on a substantial angle to horizontal or ground G. By telescopically adjusting tube 24 downward with respect to conduit 14 while forcibly urging conical member 14 against the angled hull H (phantom) and then lockably securing that orientation by the tightening of thumb screw 54, the flexible conical member 12 will resiliently deform so that water sealing surface 42 will still provide a substantially water tight seal against the hull H.

This is accomplished by providing line of weakness 48 as seen in FIG. 3 circumferentially around the conical member 50 at a mid point between the small lower end 40, and the enlarged upper end thereof. Thus, when upward force is applied in the direction of arrow F to the lower end 40 the appropriate area circumferentially around the line of weakness 48 will inwardly deform and allow the water sealing surface 48 to compliantly engage against hull H without moving substantially out of its planer free configuration.

However, should the hull H also include a curvature in the vicinity of the water inlet fitting E, the resilient nature of the thin wall section adjacent water sealing surface 42 will facilitate the resilient deformation out of a free planer configuration of the water sealing surface 42 so as to accommodate that situation as well.

For economy, the preferred form of the conical member 12 is a modified rubber head of a toilet plunger manufactured by the Water Master Company of Highland Park, New Jersey, under the trademark "TOILA-FLEX". The modification includes forming conduit 50 as an extension of threaded aperture 16.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An inboard marine engine flushing device comprising:

a flexible hollow generally cone-shaped member having an open larger end in fluid communication with an open smaller end;

a water supply conduit means connected at one end to and in fluid communication with said smaller end and connectable at its other end to a pressurized water source for supplying water into said cone-shaped member;

said larger end having a primary water sealing surface which is sized to surround a marine inboard engine sea water inlet fitting connected to the exterior surface of a boat hull;

an extendable support means having a ground engaging end and connected at the other end to said water supply conduit means for forcibly urging and retaining said larger end in generally water tight fashion against the boat hull and around the sea water inlet fitting.

2. An inboard marine engine flushing device as set forth in claim 1, wherein:

said cone-shaped member includes pliable means for permitting said water sealing surface to be elastically rotatably displaced from its free orientation with respect to said water supply conduit means to accommodate an angled boat hull.

3. An inboard marine engine flushing device as set forth in claim 2, further comprising:

a secondary water sealing surface interior to said primary water sealing surface which contacts the boat hull as said cone-shaped member is further forcibly urged against the boat hull.

4. An inboard marine engine flushing device as set foth in claim 3, wherein:

said extendable support means includes an enlarged ground-engaging distal end.

5. An inboard marine engine flushing device comprising:

a flexible, conical-shaped means for sealable engagement of a sealing surface thereof against the outer surface of a boat hull to sealably surround a marine inboard engine sea water inlet fitting on the hull exterior surface;

conduit means connected to said flexible conical-shaped means for conveying water from a pressurized water source into said flexible conical-shaped means;

said flexible conical-shaped means also for conveying water from said conduit means into the sea water inlet fitting;

an extendable support means connected to said conduit means for retaining said conical-shaped means in sealable engagement against the hull by engagement against the ground;

a line of weakness means formed transversely around an exterior mid-portion of said conical-shaped means for permitting said conical-shaped means to be elastically flexed from a free straight longitudinal alignment in response to forcibly urging said conical-shaped means against an angled boat hull outer surface.

6. An inboard marine engine flushing device as set forth in claim 5, further comprising:

a secondary hull-engaging water sealing means for increasing the water-sealing action of said conical shaped means against the boat hull exterior surface.

7. An inboard marine flushing device for flushing an inboard engine of a boat which is in dry dock comprising:

a molded thin wall flexible, hollow elastomeric generally conical member open at each end, a larger end having a planar water sealing surface formed of dual, boat hull engaging ribs and a smaller end;

said larger end generally perpendicular to the longitudinal axis of said conical member and sized to fit around a marine inboard engine sea water inlet fitting connected to the exterior surface of a boat hull;

a T-shaped water supply conduit having a first leg connectable to a water supply source, a second leg connected to, and in fluid communication with, said conical member smaller end, and a third leg;

an elongated downwardly extending ground engaging member slidably and lockably connected to said third leg whereby a lower distal end of said ground engaging member is extendable sufficiently to contact the ground to sealably urge and retain said water sealing surface against the boat hull;

8. An inboard marine engine flushing device as set forth in claim 7, further comprising:

a transverse line of weakness in said conical member which enables said conical member to be elastically bendingly deformed about the longitudinal axis of said conical member whereby said water sealing surface is realigned to an acute angle with respect to the longitudinal axis.

9. An inboard marine engine flushing device as set forth in claim 8, further comprising:

a secondary water sealing flap which extends radially inward then downwardly away from said water sealing surface;

said secondary water sealing flap sealably contacting the boat hull when said conical members is further forcibly urged against the boat hull and held thusly by said ground engaging member.

10. An inboard marine engine flushing device as set forth in claim 9, wherein:

said third leg includes an enlarged ground-engaging surface at its distal end.

* * * * *